United States Patent [19]

Bouglas

[11] Patent Number: 4,573,500

[45] Date of Patent: Mar. 4, 1986

[54] FLAME-RESISTANT FABRICS

[75] Inventor: Allan B. Bouglas, Hawick, Scotland

[73] Assignee: British Replin Limited, Ayr, Scotland

[21] Appl. No.: 619,912

[22] Filed: Jun. 12, 1984

[30] Foreign Application Priority Data

Jun. 14, 1983 [GB] United Kingdom ..... 8316172

[51] Int. Cl.[4] ..... D03D 15/12; D03D 23/00

[52] U.S. Cl. ..... 139/426 R; 139/419; 139/420 R; 57/904

[58] Field of Search ..... 139/420 R, 420 A, 420 C, 139/420 G, 426 R, 419; 57/904

[56] References Cited

U.S. PATENT DOCUMENTS

| | | | |
|---|---|---|---|
| 3,572,397 | 3/1971 | Austin | 139/426 R |
| 3,744,534 | 7/1973 | Henry et al. | 139/426 R |
| 4,001,477 | 1/1977 | Economy et al. | 139/420 R |
| 4,211,261 | 7/1980 | Mehta et al. | 139/420 R |
| 4,331,729 | 5/1982 | Weber | 139/420 R |

FOREIGN PATENT DOCUMENTS

| | | | |
|---|---|---|---|
| 579465 | 8/1946 | United Kingdom | 139/419 |

*Primary Examiner*—James Kee Chi

*Attorney, Agent, or Firm*—Leydig, Voit & Mayer, Ltd.

[57] ABSTRACT

A fire-resistant fabric is formed by standing warps and wefts of a fire-resistant yarn such as a carbon fibre yarn. Each standing warp is covered by covering warps of a wear-resistant yarn which are cross-woven on the respective standing warps and which are bound on one side of the standing warps by the wefts. The covering warps and the wefts are closely beaten up to the fell of the fabric after each pick so that the covering warps form, on one surface of the fabric, ribs which give the fabric a hard wearing outer surface and which protect the fire-resistant yarns from wear. When subjected to fire, the wear-resistant yarn is removed but the fire-resistant warp and weft yarns form a mesh or grid which prevents the passage of flame.

2 Claims, 2 Drawing Figures

FLAME-RESISTANT FABRICS

BACKGROUND TO THE INVENTION

1. Field of the Invention

The invention relates to flame-resistant fabrics. In many circumstances, particularly in aircraft, fabrics are required to perform a wide variety of functions. For example, fabric used for aircraft seats must be as light as possible in weight so that the overall aircraft weight is not unduly increased, and must be hard wearing to minimise the frequency of replacement. It is also a requirement in aircraft that the fabric or the area covered by the fabric should not allow the passage of flames.

2. Review of the Prior Art

There are a number of yarns which can be woven into fabrics having fire-retardent properties. It is a problem, however, that the majority of these yarns are not hard wearing; they have a short fibre length which wears easily. In view of this, it has been proposed to form a fire-retardent fabric by the use of a composite fabric formed of two layers of woven material, the outer, wear-resistant, fabric being of, for example a wool yarn and the under fabric being formed of a yarn which is fire-retardent.

Such a composite fabric is, however, comparatively heavy because it is formed of two layers and is difficult to handle and install.

SUMMARY OF THE INVENTION

According to the invention, there is provided a fire-resistant fabric formed by standing warps of a fire-resistant yarn, each warp having an associated covering warp of a wear-resistant yarn cross-woven thereon, and wefts of a fire-resistant yarn binding the covering warps on one side only of the standing warps, the covering warps and the wefts being beaten up to the fell of the fabric after each pick, so that the covering warps form a ribbed wear-resistant surface on one side of the fabric and the fire-resistant yarns are not exposed on said wear-resistant surface but form a fire-resistant grid or mesh when the covering warps are removed by fire.

The standing warps and the wefts may be of carbon fibre.

BRIEF DESCRIPTION OF THE DRAWINGS

The following is a more detailed description of one embodiment of the invention, by way of example, reference being made to the accompanying drawings in which.

DESCRIPTION OF THE PREFERRED EMBODIMENTS

It will be appreciated that, for the purposes of clarity, the drawings are schematic. In particular, the sizes and relative proportions of the component yarns and the fabric are not to scale.

Figure 1:
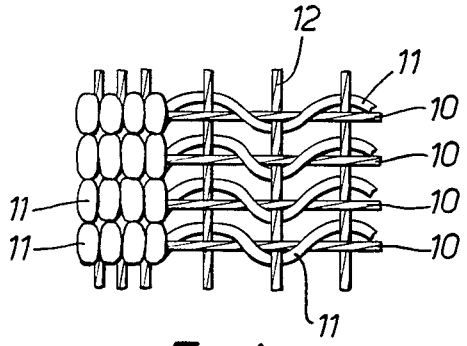
FIG. 1 is a schematic plan view of a fire-resistant fabric, one half of the fabric being shown beaten-up to the fell after each pick and the other half before beating up.

Referring first to FIG. 1, the fire-resistant fabric comprises standing warps 10 of a fire-resistant material. Each standing warp 10 has a covering 11 of a wool yarn cross-woven thereon. These covering warps are bound by wefts 12 also of carbon fibre. As shown in the left-hand half of FIG. 1, the covering warp and wefts are beaten up to the fell of the fabric after each pick.

Thus, in the finished fabric, the covering warps 11 form a ribbed surface which covers completely the standing warps and the wefts. Since the wool yarn of the covering warps is highly resistant to wear, this gives the fabric a hard wearing surface.

Figure 2:
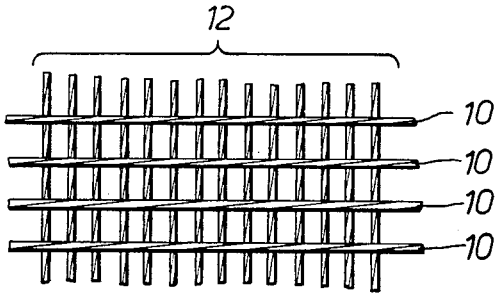
FIG. 2 is a schematic plan view of the fabric following a fire.

If the fabric is subjected to fire, the wool will burn away but the carbon fibre will remain to leave a mesh or grid (see FIG. 2) which the flames will not be able to penetrate. Thus the fabric forms, in a single layer, both the wear-resistant surface the fire-resistant mesh or grid. The fabric is thus light in weight, hard wearing and fire-resistant. This makes it particularly suitable for use in aircraft for seating covers.

It will be appreciated that the wool yarn may be replaced by any other suitable hard wearing yarn; such as yarns of artificial fibres. It will also be appreciated that the carbon fibre yarn may be replaced by any suitable fire-resistant yarn such as spun asbestos yarn or fire-resistant yarns sold under the trade marks NOMEX, TEKLAN and LENSING.

I claim:

1. A single-layer woven fire-resistant furnishing fabric comprising:

standing warps of a fire-resistant yarn, a covering warp of a wear-resistant yarn cross-woven on each standing warp, wefts of a fire-resistant yarn binding the covering warps on one side only of the standing warps, a ribbed wear-resistant outer surface to the fabric formed by the beating-up to the fell of the covering warps and the wefts, after each pick, and a fire-resistant grid formed by the standing warps and the wefts, after said beating-up, said fire-resistant grid not being exposed on said ribbed wear-resistant outer surface until said covering warps are removed by fire.

2. A single-layer woven fire-resistant furnishing fabric according to claim 1, wherein the standing warps and the wefts are of a carbon fibre yarn.

* * * * *